US011536220B1

(12) United States Patent
Chittenden et al.

(10) Patent No.: US 11,536,220 B1
(45) Date of Patent: Dec. 27, 2022

(54) PASSIVE IGNITER COOLING IN CYLINDER HEAD ASSEMBLY

(71) Applicant: Caterpillar Inc., Peoria, IL (US)

(72) Inventors: Jonathan Richard Chittenden, West Lafayette, IN (US); Jeff Allen Howard, West Lafayette, IN (US); Viorel Petrariu, Lafayette, IN (US); John W Milem, Brimfield, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/691,516

(22) Filed: Mar. 10, 2022

(51) Int. Cl.
*F02F 1/40* (2006.01)
*F01P 3/14* (2006.01)
*F01P 3/16* (2006.01)

(52) U.S. Cl.
CPC ..... *F02F 1/40* (2013.01); *F01P 3/14* (2013.01); *F01P 3/16* (2013.01)

(58) Field of Classification Search
CPC ..... F02F 1/40; F02F 1/38; F02F 1/36; F02F 1/34; F02F 1/242; F02F 1/10; F02F 2200/00; F02F 2200/06; F01P 3/14; F01P 3/16; F01P 3/02; F01P 2003/027; F01P 2003/028
See application file for complete search history.

(56) References Cited

U.S. PATENT DOCUMENTS

| | | | | |
|---|---|---|---|---|
| 10,385,800 | B2 | 8/2019 | Hyde et al. | |
| 2006/0054112 | A1* | 3/2006 | Paul | F02F 1/40 123/41.82 R |
| 2016/0273481 | A1* | 9/2016 | Ickinger | F02F 1/38 |
| 2019/0284985 | A1* | 9/2019 | Perr | H01T 13/54 |

FOREIGN PATENT DOCUMENTS

| | | | | |
|---|---|---|---|---|
| CN | 111075591 | A * | 4/2020 | F01P 3/16 |
| DE | 10248663 | A1 * | 5/2004 | F02F 1/14 |
| DE | 10321035 | B3 * | 1/2005 | F02F 1/40 |
| DE | 102007062347 | A1 * | 6/2009 | F02F 1/40 |
| FR | 3004761 | A1 | 10/2014 | |
| WO | 2020051607 | A1 | 3/2020 | |

* cited by examiner

*Primary Examiner* — Grant Moubry
(74) *Attorney, Agent, or Firm* — Brannon Sowers & Cracraft PC

(57) ABSTRACT

A cylinder head in a cylinder head assembly includes an upper deck, a fire deck, gas exchange conduits, and a coolant cavity extending peripherally around the gas exchange conduits. The cylinder head also includes an igniter socket having an igniter post, and a radially outward sleeve step continuously circumferential of an igniter bore center axis. A cooling moat is formed between the igniter post and the sleeve step. The coolant cavity includes a valve bridge through-channel and a valve bridge part-way channel each fluidly connected to the igniter socket to provide coolant flow into and out of the cooling moat passively.

20 Claims, 4 Drawing Sheets

PASSIVE IGNITER COOLING IN CYLINDER HEAD ASSEMBLY

TECHNICAL FIELD

The present disclosure relates generally to cooling an igniter in a cylinder head, and more particularly to passive cooling of an igniter without direct feed of coolant.

BACKGROUND

Internal combustion engines are applied for diverse purposes throughout the world, in applications ranging from vehicle propulsion to electrical power generation to operation of gas and liquid compressors and pumps. Burning a combustible fuel with air in combustion cylinders in the engine produces a rapid pressure and temperature rise exploited to produce power but also subjecting components of the engine to mechanical and thermal stresses and strains. In most instances active cooling by way of a liquid coolant conveyed through parts of the engine is required.

A great many different water jacket and related coolant plumbing structures have been proposed over the years in an effort to optimally manage engine temperatures. In many engines an igniter such as a sparkplug, or a prechamber ignition device, is supported in a cylinder head. These igniters tend to be sensitive to excessive temperatures. Engine head configurations can nevertheless create challenges in optimally cooling an igniter with liquid coolant. Ignition problems, structural failures, and thermal fatigue cracks and the like are common signs of inadequate cooling.

Increased engineering resources have been directed at optimizing cooling of igniters in an engine head in recent years. Optimized coolant flow and geometric arrangements of coolant passages can provide operating benefits as well as increased engine power density. U.S. Pat. No. 10,385,800 employs cross-drilled coolant passages to feed coolant directly to a cooling moat, enabling a pumped positive flow of coolant to dissipate heat of components of an igniter. While the concept disclosed in the '800 patent may have various advantages, there is always room for improvement and development of alternative strategies in relation to igniter cooling and manufacturability of the various components.

SUMMARY

In one aspect, a cylinder head includes a cylinder head casting having an upper deck, a fire deck, four gas exchange conduits extending to four gas exchange openings in the fire deck, a coolant cavity formed between the upper deck and the fire deck and extending peripherally around the four gas exchange conduits, and an igniter bore defining a bore center axis and extending downwardly through the upper deck to the coolant cavity. The cylinder head casting further includes an igniter socket having a radially inward igniter post, a radially outward sleeve step that is circumferential of the bore center axis, and a cooling moat formed between the igniter post and the sleeve step. The coolant cavity includes a valve bridge through-channel extending to the igniter socket and formed between two of the four gas exchange conduits, and a valve bridge part-way channel extending from the igniter socket and formed between two of the four gas exchange conduits.

In another aspect, a cylinder head assembly includes a cylinder head having formed therein an igniter bore extending downwardly from an upper deck to a coolant cavity and defining a bore center axis, and an igniter socket including an igniter post extending upwardly from a fire deck in a direction of the coolant cavity. The cylinder head assembly further includes an igniter sleeve having a first axial sleeve end within the igniter bore, a second axial sleeve end interference-fitted with the igniter post, and a plurality of stop surfaces located between the first axial sleeve end and the second axial sleeve end. The igniter socket further includes a sleeve step extending continuously circumferentially around the bore center axis and contacted by the plurality of stop surfaces, and a cooling moat formed between the sleeve step and the igniter post and receiving the second axial sleeve end. A plurality of coolant openings are defined between the igniter sleeve and the sleeve step at locations angularly between the plurality of stop surfaces, circumferentially around the bore center axis, and coolant flow between the coolant cavity and the cooling moat is confined to the plurality of coolant openings.

In still another aspect, a method of cooling an igniter in a cylinder head assembly includes conveying coolant through a first valve bridge channel of a coolant cavity to an igniter socket in a cylinder head, and conveying the coolant through a cooling moat of the igniter socket receiving an igniter sleeve for the igniter. The method further includes exchanging heat between the coolant and the igniter sleeve within the cooling moat, conveying the coolant from the igniter socket to a second valve bridge channel of the coolant cavity, and limiting a flow of the coolant between the cooling moat and the coolant cavity to a finite number of coolant openings defined between the igniter sleeve and the igniter socket.

DETAILED DESCRIPTION

Figure 1:
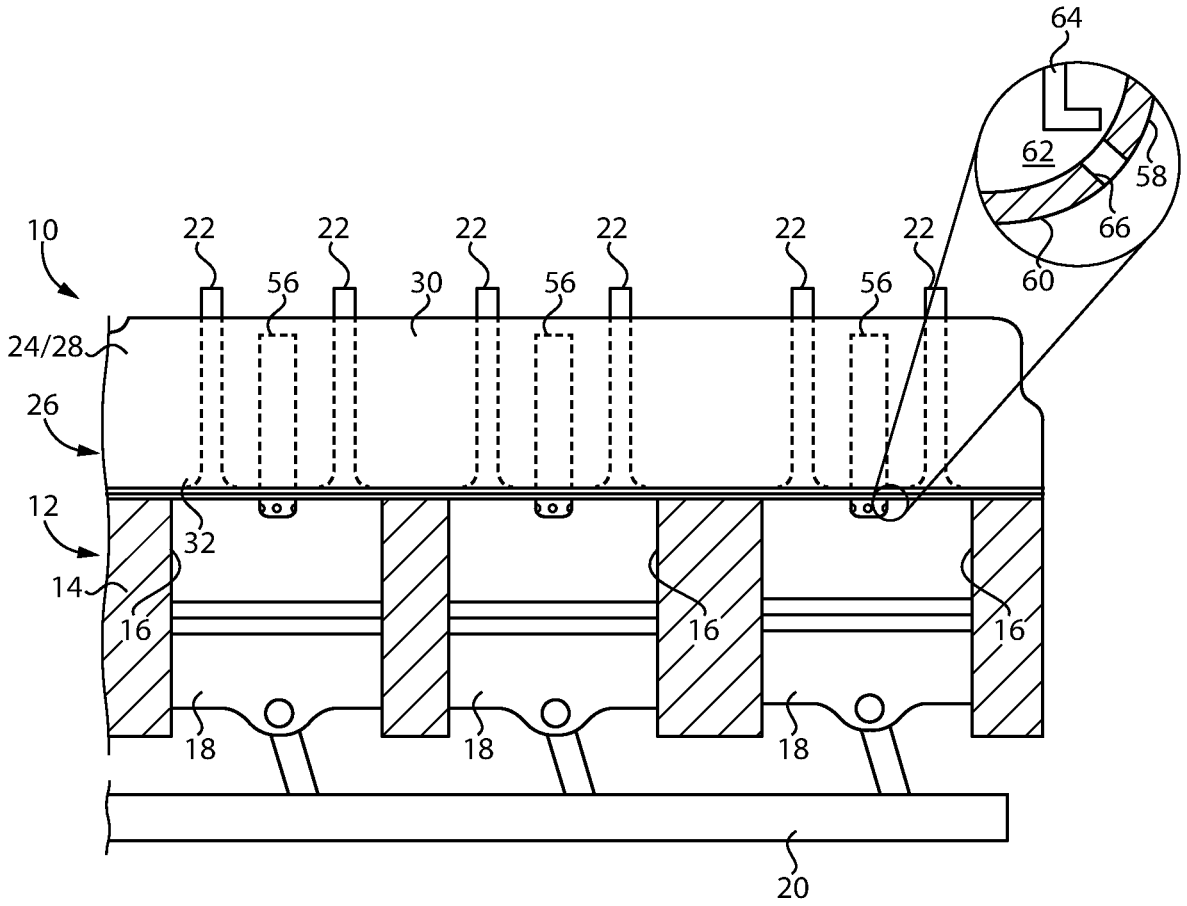
FIG. 1 is a side diagrammatic view of an internal combustion engine system, according to one embodiment.

Referring to the drawings generally, but focusing on FIG. 1, there is shown an internal combustion engine system 10, according to one embodiment. Engine system 10 includes an engine 12 having a cylinder block 14 with a plurality of combustion cylinders 16 formed therein. A plurality of pistons 18 are each movable in a corresponding one of cylinders 16, between a top-dead-center position and a bottom-dead-center position, typically in a four-cycle pattern. Pistons 18 are coupled with a rotatable crankshaft 20, operable to power a load such as an electrical generator, a pump, a compressor, a driveline in a vehicle, et cetera. A plurality of engine valves 22, typically including two exhaust valves and two intake valves for each cylinder 16, are supported in a cylinder head 24 attached to cylinder block 14. Engine valves 22 operate to control fluid communications between cylinders 16 and an intake system and an exhaust system, neither of which is explicitly shown. Engine 12 may operate on a variety of fuels, including a gaseous hydrocarbon fuel such as natural gas, methane, ethane, or various blends.

Engine valves 22 are supported in a cylinder head 24 in a cylinder head assembly 26. Cylinder head 24 may include a one-piece cylinder head casting 28. In the illustrated embodiment cylinder head 24 is a so-called slab cylinder head where a one-piece casting is associated with multiple cylinders 16, and potentially all cylinders 16 in engine 12. In other embodiments cylinder head 24 could include multiple separate castings each associated with one cylinder 16. Cylinder head 24 and cylinder head casting 28 are terms used herein, at times, interchangeably. A liquid coolant, such as conventional liquid engine coolant, may be conveyed between cylinder block 14 and cylinder head 24 and circulated through a heat exchanger such as a conventional radiator according to well-known practices.

Engine system 10 may also include a plurality of igniters 56, hereinafter referred to at times in the singular, each associated with one of cylinders 16.

As can be seen in the detailed enlargement of FIG. 1, igniter 56 may include an igniter housing 58 having a tip 60 positioned at least partially within one of cylinders 16. A combustion prechamber 62 is formed in tip 60. One or more spark electrodes 64 is positioned within prechamber 62 and forms a spark gap with housing 58. During operating engine 12 a mixture of fuel and air can be urged by movement of an associated piston 18 through one or more ports 66 formed in tip 60 to form an ignition charge of fuel and air that is ignited at a spark gap between spark electrode 64 and housing 58. Ignition of the ignition charge produces jets of hot, combusting gases out through port(s) 66 to ignite a larger main charge of fuel and air in the associated cylinder 16. Igniter 56 is shown configured as a prechamber sparkplug. In other instances, a different type of igniter, such as a prechamber ignition device receiving a direct feed of a fuel to form an ignition charge, might be used. The present disclosure is contemplated as applicable without regard to electrode configuration, number, or polarity. Moreover, while three cylinders 16 are shown, it will be appreciated that engine 12 might include any number of cylinders in any suitable arrangement.

Figure 2:
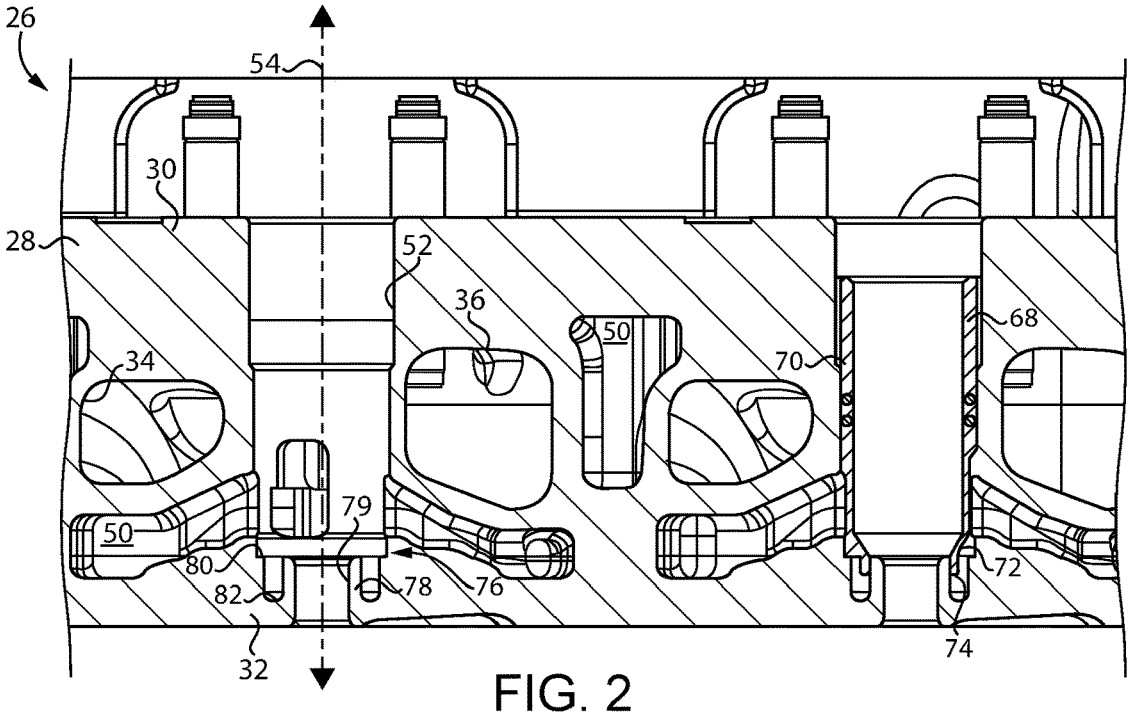
FIG. 2 is a sectioned side diagrammatic view of a cylinder head assembly, according to one embodiment.
Figure 6:
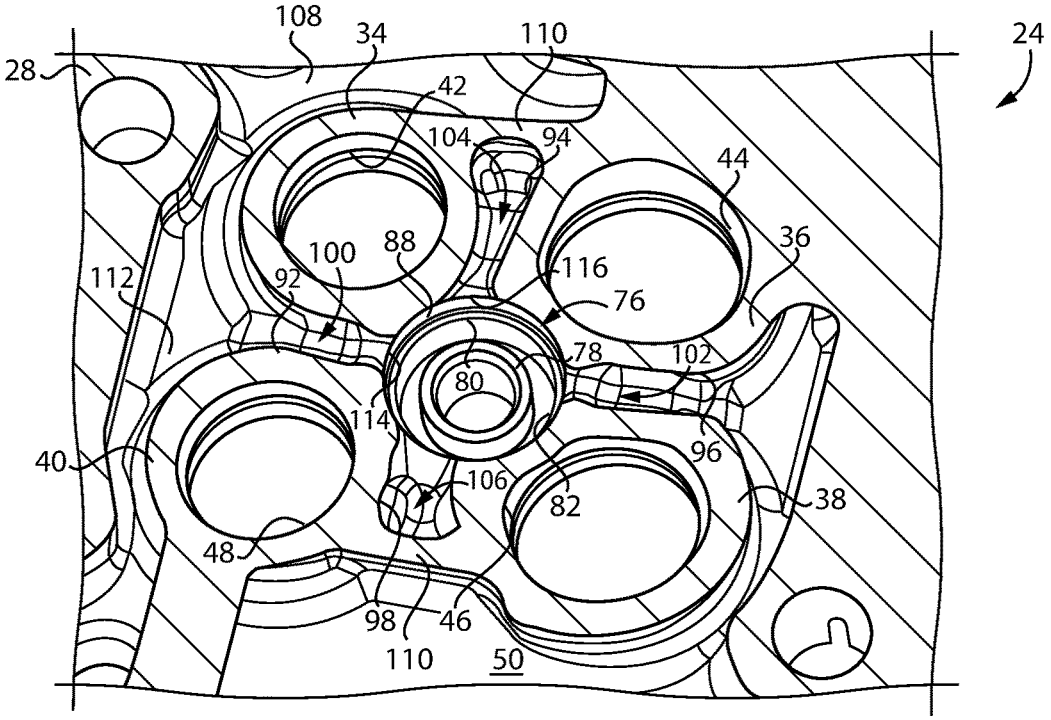
FIG. 6 is a sectioned view, in perspective, of a cylinder head, according to one embodiment.
Figure 7:
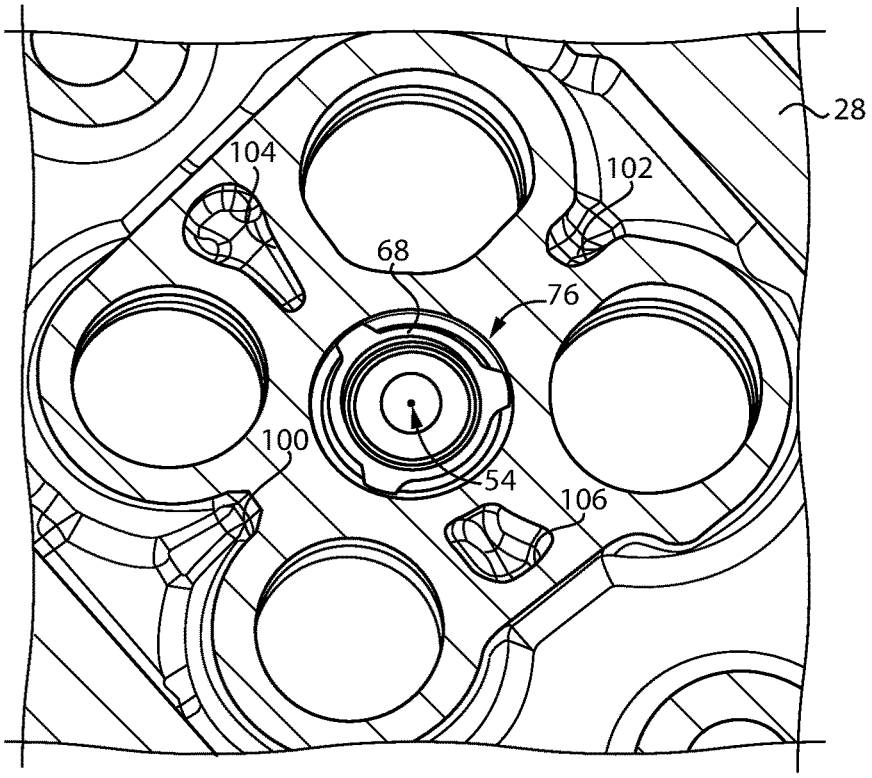
FIG. 7 is another sectioned view of a cylinder head as in FIG. 6 forming a cylinder head assembly with an igniter, according to one embodiment.

As also illustrated in FIG. 2, cylinder head 24 includes an upper deck 30, a lower fire deck 32, and gas exchange conduits 34 and 36 extending to gas exchange openings in fire deck 32. Four gas exchange conduits 34, 36, 38, 40 extending to four gas exchange openings 42, 44, 46, 48 in fire deck 32 are illustrated in FIGS. 6 and 7. In the illustrated embodiment gas exchange conduits 34 and 40 are exhaust conduits, and gas exchange conduits 36 and 38 are intake conduits. Gas exchange openings 42, 44, 46, 48 are arranged in a generally rectangular or square pattern, although the present disclosure is not thereby limited. Gas exchange conduits 34, 36, 38, 40 extend through a coolant cavity 50 formed between upper deck 30 and fire deck 32. Coolant cavity 50 extends peripherally around the four gas exchange conduits 34, 36, 38, 40. Liquid coolant can be conveyed by suitable ports generally upward through coolant cavity 50 to exchange heat with intake conduits and other structures in cylinder head 24, thenceforth conveyed to a radiator.

Figure 3:
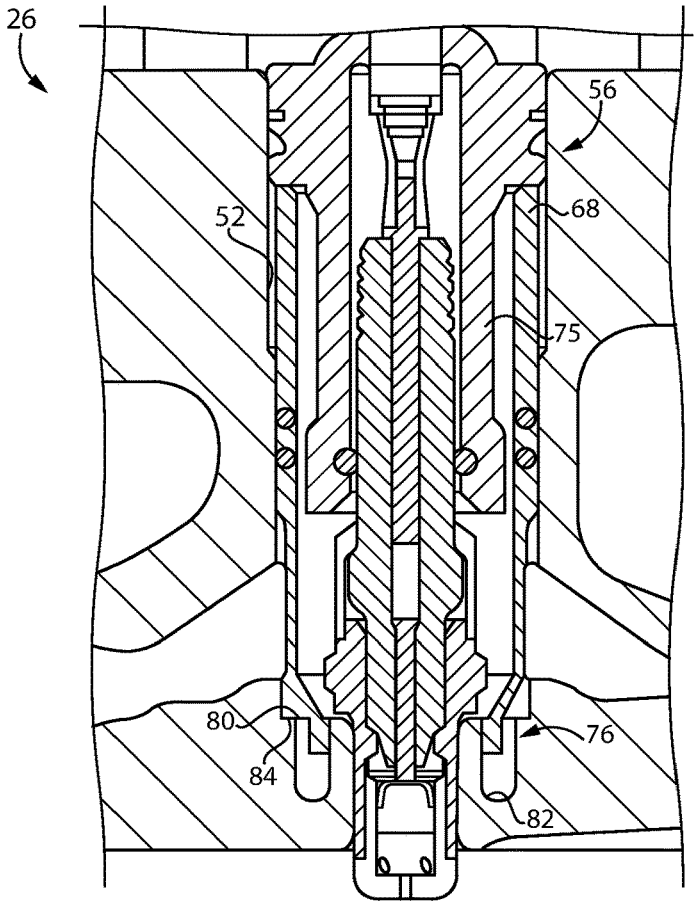
FIG. 3 is a sectioned side diagrammatic view of a portion of the cylinder head assembly as in FIG. 2.
Figure 4:
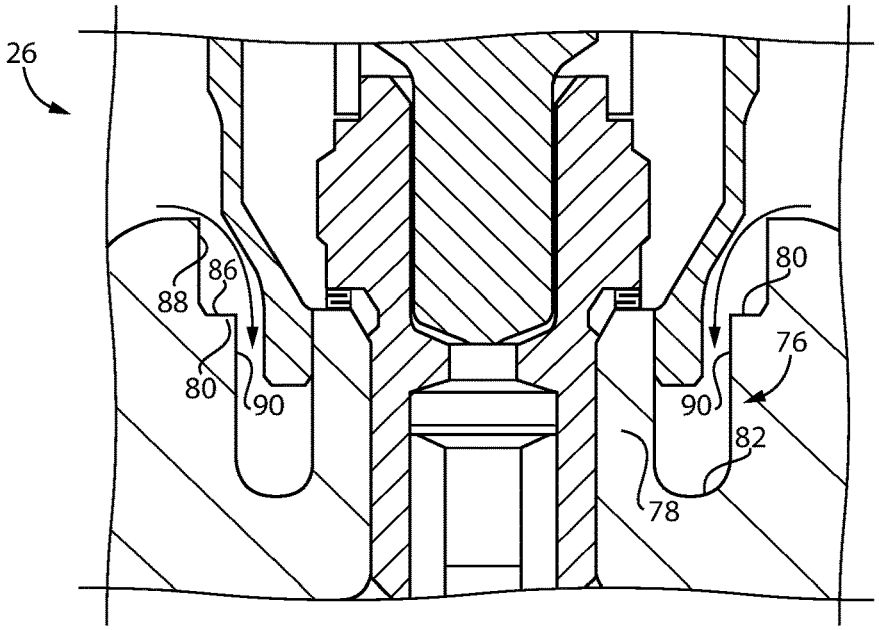
FIG. 4 is another sectioned side diagrammatic view of a portion of a cylinder head assembly as in FIG. 2.
Figure 5:
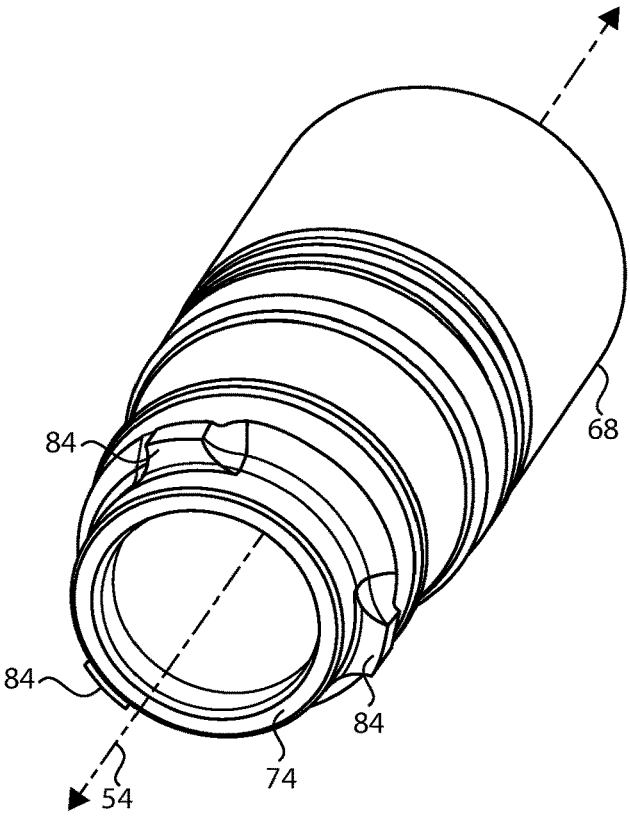
FIG. 5 is a perspective view of an igniter sleeve, according to one embodiment.

Focusing now on FIGS. 2-4, cylinder head 24 further includes an igniter bore 52 defining a bore center axis 54 and extending downwardly through upper deck 30 to coolant cavity 50. Cylinder head 24 further includes an igniter socket 76 having a radially inward igniter post 78 extending upwardly from fire deck 32 in a direction of coolant cavity 50, and defining an opening 79 extending through fire deck 32. Igniter post 78 may be cylindrical and supports igniter 56 in cylinder head assembly 26. Igniter 56 includes a sleeve 68, and a sparkplug 75 supported in sleeve 68 and extending through opening 79. Igniter sleeve 68 includes a first axial sleeve end 70 within igniter bore 52, and a second axial sleeve end 72 interference-fitted with igniter post 78. Second axial sleeve end 72 includes a tip 74. Igniter socket 76 further includes a radially outward sleeve step 80 that is continuously circumferential of bore center axis 54, and a cooling moat 82 formed between igniter post 78 and sleeve step 80. Sleeve step 80 may include an upward facing step surface 86, generally oriented normal to bore center axis 54, and a peripheral wall surface 88 radially outward of upward facing step surface 86. Peripheral wall surface 88 may be cylindrical, and sleeve step surface 86 may be planar. Step surface 86 may extend from peripheral wall surface 88 to a cylindrical outer moat surface 118.

It will be recalled igniter sleeve 68 may be interference-fitted upon igniter post 78. Igniter sleeve 68 may further include a plurality of stop surfaces 84 formed, for example, on protruding stop feet (not numbered), located between first axial sleeve end 70 and second axial sleeve end 72. When igniter sleeve 68 is installed in cylinder head 28 igniter sleeve 68 may be pressed downwardly into interference-fit engagement with igniter post 78, and stopped by contact between stop surfaces 84 and radially outward sleeve step 80. A plurality of coolant openings 90 are defined between igniter sleeve 68 and sleeve step 80 at locations angularly between stop surfaces 84, circumferentially around bore center axis 54, such that coolant flow between coolant cavity 50 and cooling moat 82 is confined to coolant openings 90. Put differently, no coolant flows into or out of cooling moat 82 but by way of openings 90 in at least some embodiments, the significance of which will be further apparent from the following description. Stop surfaces 84 and coolant openings 90 may each number 3 or 4 in some embodiments.

It will be recalled cylinder head 24 includes four gas exchange conduits 34, 36, 38, 40. Where implemented as a slab cylinder head, cylinder head casting 28 may include four gas exchange conduits for each of a plurality of cylinders. Cylinder head 24 further includes four valve bridges 92, 94, 96, 98 in an alternating arrangement with the four gas exchange conduits 34, 36, 38, 40, circumferentially around bore center axis 54. Coolant cavity 50 further includes a first valve bridge through-channel 100 and a second valve bridge through-channel 102 extending to igniter socket 76 and formed in two of the four valve bridges, valve bridges 92 and 96 in the illustrated embodiment. Coolant cavity 50 also includes a first valve bridge part-way channel 104 and a second valve bridge part-way channel 106 formed in a different two of the four valve bridges, and in the illustrated embodiment valve bridges 94 and 98. It can be noted the first and the second valve bridge through-channels 100 and 102 are in an alternating arrangement with the first and the second valve bridge part-way channels 104 and 106, circumferentially around bore center axis 54.

With focus now on FIGS. 6 and 7, coolant cavity 50 forms a peripherally outward cavity space 108 that is circumferential of the four gas exchange conduits 34, 36, 38, 40. Each respective valve bridge through-channel 100 and 102 fluidly connects peripherally outward cavity space 108 to igniter socket 76. Cylinder head 24 and cylinder head casting 28 may include cast material 110 blocking each respective valve bridge part-way channel 104 and 106 from peripherally outward cavity space 108. In the illustrated embodiment valve bridge part-way channels 104 and 106 are arranged opposite to one another, circumferentially around bore center axis 54, and valve bridge through-channels 100 and 102 are also arranged opposite to one another circumferentially around bore center axis 54. Other embodiments could include adjacent valve bridge through-channels and adjacent valve bridge part-way channels, or some other configuration. In view of the foregoing description it will be appreciated that valve bridge through-channels 100 and 102 extend all the way through the respective valve bridges 92 and 96, whereas valve bridge part-way channels 104 and 106 extend only part-way through the respective valve bridges 94 and 98. Valve bridge part-way channels 104 and 106 may be contoured, including by way of surface curvature adjacent to and along cast material 110, to direct an outgoing flow of coolant from igniter socket 76 generally upward in cylinder head 24. In accordance with these and other design principles a flow of coolant through cylinder head 24 in coolant cavity 50 that is generally undirected but for flowing upward can be biased to flow at least predominantly in a direction of igniter socket 76 (radially inward) through valve bridge through-channels 100 and 102, and at least predominantly in a direction away from igniter socket 76 (radially outward) through part-way channels 104 and 106, as further discussed herein.

INDUSTRIAL APPLICABILITY

Making cylinder head assembly 26 can include casting material, such as an iron or iron alloy material, to form a unitary body of sufficient size and configuration generally for installation and service associated with a desired number of cylinders in an engine. Some of the surfaces of the casting may be left as-cast, while others may be machined. According to the present disclosure, each valve bridge through-channel 100 and 102 and each valve bridge part-way channel 104 and 106 may be formed by an as-cast surface 112. Features of igniter socket 76, however, may be machined using one or more machining tools and/or passes, such that peripheral wall surface 88, upward facing step surface 86, and surfaces forming cooling moat 82 and igniter post 78 are machined. In an implementation, and as can be seen in FIG. 6, peripheral wall surface 88 forms a first common edge 114, produced by machining, with as-cast surface 112 at valve bridge through-channel 100. Peripheral wall surface 88 may form a second common edge 116, produced by machining, with as-cast surface 112 at valve bridge part-way channel 104. Common edges (not numbered) may analogously be formed between peripheral wall surface 88 and each of valve bridge through-channel 102 and valve bridge part-way channel 106. With cylinder head 24 thusly prepared igniter sleeve 68 and sparkplug 75 can be installed via interference-fitting, for example.

Operating engine system 10 will include combusting fuel and air in cylinder 16 as noted above. During operation igniter 56 will tend to heat in response to elevated temperatures in cylinder 16 as well as in prechamber 62. Coolant can be pumped through cylinder head 24, and into coolant cavity 50 such that coolant is conveyed through a first valve bridge channel of coolant cavity 50, including one or both of valve bridge through-channels 100 and 102, to igniter socket 76. The coolant may be conveyed from valve bridge through-channels 100 and 102 through cooling moat 82 of igniter socket 76 receiving igniter sleeve 68. Coolant conveyed through cooling moat 82 will enable exchanging heat between the coolant and igniter sleeve 28 within cooling moat 82. Coolant conveyed through cooling moat 82 can be conveyed from igniter socket 76 to a second valve bridge channel of coolant cavity 50, including one or both of valve bridge part-way channels 104 and 106. As discussed herein a flow of coolant between cooling moat 82 and coolant cavity 50 is limited to coolant openings 90. Coolant openings 90 are finite in number, including for example 3 or 4, and are defined between igniter sleeve 68 and igniter socket 76. More particularly, cylinder openings 90 may be defined at locations between stop surfaces 84, circumferentially around bore center axis 54, between igniter sleeve 68 and sleeve step 80.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A cylinder head comprising:

a cylinder head casting including an upper deck, a fire deck, four gas exchange conduits extending to four gas exchange openings in the fire deck, a coolant cavity formed between the upper deck and the fire deck and extending peripherally around the four gas exchange conduits, and an igniter bore defining a bore center axis and extending downwardly through the upper deck to the coolant cavity;

the cylinder head casting further including an igniter socket having a radially inward igniter post, a radially outward sleeve step that is circumferential of the bore center axis, and a cooling moat formed between the igniter post and the sleeve step; and the coolant cavity including a valve bridge through-channel extending to the igniter socket and formed between two of the four gas exchange conduits, and a valve bridge part-way channel extending from the igniter socket and formed between two of the four gas exchange conduits.

2. The cylinder head of claim 1 wherein the coolant cavity includes a second valve bridge through-channel arranged opposite to the first valve bridge through-channel, circumferentially around the bore center axis.

3. The cylinder head of claim 2 wherein the coolant cavity includes a second valve bridge part-way channel arranged opposite to the first valve bridge part-way channel, circumferentially around the bore center axis.

4. The cylinder head of claim 3 wherein:

the coolant cavity forms a peripherally outward cavity space that is circumferential of the four gas exchange conduits;

each respective valve bridge through-channel fluidly connects the peripherally outward cavity space to the igniter socket; and the cylinder head casting includes cast material blocking each respective valve bridge part-way channel from the peripherally outward cavity space.

5. The cylinder head of claim 3 wherein each respective valve bridge part-way channel is contoured to direct an outgoing flow of coolant from the igniter socket upward in the cylinder head casting.

6. The cylinder head of claim 1 wherein the igniter post is cylindrical.

7. The cylinder head of claim 6 wherein the sleeve step includes an upward facing step surface, and a peripheral wall surface radially outward of the upward facing step surface.

8. The cylinder head of claim 6 wherein the peripheral wall surface is cylindrical, and the upward facing step surface extends from the peripheral wall surface to a cylindrical outer moat surface.

9. The cylinder head of claim 7 wherein each of the valve bridge through-channel and the valve bridge part-way channel is formed by an as-cast surface, and the peripheral wall surface includes a machined surface forming a first common edge with the as-cast surface at the valve bridge through-channel, and a second common edge with the as-cast surface at the valve bridge part-way channel.

10. A cylinder head assembly comprising:

a cylinder head having formed therein an igniter bore extending downwardly from an upper deck to a coolant cavity and defining a bore center axis, and an igniter socket including an igniter post extending upwardly from a fire deck in a direction of the coolant cavity;

an igniter sleeve including a first axial sleeve end within the igniter bore, a second axial sleeve end interference-fitted with the igniter post, and a plurality of stop surfaces located between the first axial sleeve end and the second axial sleeve end;

the igniter socket further including a sleeve step extending continuously circumferentially around the bore center axis and contacted by the plurality of stop surfaces, and a cooling moat formed between the sleeve step and the igniter post and receiving the second axial sleeve end; and a plurality of coolant openings are defined between the igniter sleeve and the sleeve step at locations angularly between the plurality of stop surfaces, circumferentially around the bore center axis, and coolant flow between the coolant cavity and the cooling moat is confined to the plurality of coolant openings.

11. The cylinder head assembly of claim 10 wherein the plurality of stop surfaces and the plurality of coolant openings each number 3 or 4.

12. The cylinder head assembly of claim 10 wherein:

the cylinder head further includes four gas exchange conduits and four valve bridges in an alternating arrangement with the four gas exchange conduits circumferentially around the bore center axis; and the coolant cavity further includes a first valve bridge through-channel and a second valve bridge through-channel formed in two of the four valve bridges, and a first valve bridge part-way channel and a second valve bridge part-way channel formed in a different two of the four valve bridges.

13. The cylinder head assembly of claim 12 wherein the first and the second valve bridge through-channels are in an alternating arrangement with the first and the second valve bridge part-way channels, circumferentially around the bore center axis.

14. The cylinder head assembly of claim 10 wherein the sleeve step includes an upward facing step surface oriented normal to the bore center axis, and a peripheral wall surface radially outward of the upward facing step surface.

15. The cylinder head assembly of claim 14 wherein the peripheral wall surface is cylindrical.

16. The cylinder head assembly of claim 10 further comprising a sparkplug igniter within the igniter sleeve.

17. A method of cooling an igniter in a cylinder head assembly comprising:

conveying coolant through a first valve bridge channel of a coolant cavity to an igniter socket in a cylinder head;

conveying the coolant through a cooling moat of the igniter socket receiving an igniter sleeve for the igniter;

exchanging heat between the coolant and the igniter sleeve within the cooling moat;

conveying the coolant from the igniter socket to a second valve bridge channel of the coolant cavity; and limiting a flow of the coolant between the cooling moat and the coolant cavity to a finite number of coolant openings defined between the igniter sleeve and the igniter socket.

18. The method of claim 17 wherein the conveying coolant through a cooling moat includes conveying the coolant through a cooling moat extending circumferentially around an igniter post interference-fitted with the igniter sleeve in the cylinder head.

19. The method of claim 18 wherein the limiting a flow of the coolant includes limiting the flow to a finite number of coolant openings defined between the igniter sleeve and a sleeve step of the igniter socket extending continuously circumferentially around the cooling moat and the igniter post.

20. The method of claim 17 wherein the conveying coolant through a first valve bridge channel to an igniter socket includes conveying the coolant through a valve bridge through-channel, and the conveying the coolant from the igniter socket to a second valve bridge channel includes conveying the coolant to a valve bridge part-way channel.

* * * * *